US011149666B2

(12) United States Patent
Echigo

(10) Patent No.: US 11,149,666 B2
(45) Date of Patent: Oct. 19, 2021

(54) CONTROL METHOD AND CONTROL DEVICE FOR VEHICULAR INTERNAL COMBUSTION ENGINE

(71) Applicant: NISSAN MOTOR CO., LTD., Yokohama (JP)

(72) Inventor: Ryo Echigo, Kanagawa (JP)

(73) Assignee: NISSAN MOTOR CO., LTD., Yokohama (JP)

( * ) Notice: Subject to any disclaimer, the term of this patent is extended or adjusted under 35 U.S.C. 154(b) by 0 days.

(21) Appl. No.: 16/767,665

(22) PCT Filed: Nov. 29, 2017

(86) PCT No.: PCT/JP2017/042751
§ 371 (c)(1),
(2) Date: May 28, 2020

(87) PCT Pub. No.: WO2019/106740
PCT Pub. Date: Jun. 6, 2019

(65) Prior Publication Data
US 2020/0378321 A1 Dec. 3, 2020

(51) Int. Cl.
*F02D 23/00* (2006.01)
*F02D 41/00* (2006.01)
(Continued)

(52) U.S. Cl.
CPC ..... *F02D 41/0007* (2013.01); *F02D 23/00* (2013.01); *F02D 41/04* (2013.01);
(Continued)

(58) Field of Classification Search
CPC ..... F02D 23/00; F02D 41/0007; F02D 41/04; F02D 41/1475; F02D 41/3064; F02D 2041/001; F02D 2200/503; F02D 2250/21
See application file for complete search history.

(56) References Cited

U.S. PATENT DOCUMENTS

2013/0255647 A1 10/2013 Akashi et al.
2017/0152801 A1 6/2017 Lofgren
2018/0266344 A1* 9/2018 Moriyasu ..... F01N 3/101

FOREIGN PATENT DOCUMENTS

DE 102014019556 A1 6/2016
FR 3041696 A1 3/2017
(Continued)

*Primary Examiner* — Audrey B. Walter
(74) *Attorney, Agent, or Firm* — Faegre Drinker Biddle & Reath LLP

(57) ABSTRACT

A vehicular internal combustion engine system includes an internal combustion engine and an electric intake air supply device. The internal combustion engine is shifted into a stoichiometric combustion mode, and a lean combustion mode. The electric intake air supply device is driven by an on-vehicle battery, and employed to contribute a part of intake air quantity at least under a specific operating condition when in the lean combustion mode. A control method includes: determining an electric energy of the electric intake air supply device that is required to maintain achievement of a target air fuel ratio of the lean combustion mode when in a lean combustion operation region; and causing a shift from the lean combustion mode into a stoichiometric combustion mode when the on-vehicle battery is in an insufficient state of charge with respect to the electric energy.

8 Claims, 5 Drawing Sheets

(51) Int. Cl.
*F02D 41/04* (2006.01)
*F02D 41/14* (2006.01)
*F02D 41/30* (2006.01)

(52) U.S. Cl.
CPC ..... *F02D 41/1475* (2013.01); *F02D 41/3064* (2013.01); *F02D 2041/001* (2013.01); *F02D 2200/503* (2013.01); *F02D 2250/21* (2013.01)

(56) References Cited

FOREIGN PATENT DOCUMENTS

| | | | |
|---|---|---|---|
| JP | 2001-90543 | A | 4/2001 |
| JP | 2006-348761 | A | 12/2006 |
| JP | 2009-228586 | A | 10/2009 |
| JP | 2017-57770 | A | 3/2017 |

* cited by examiner

CONTROL METHOD AND CONTROL DEVICE FOR VEHICULAR INTERNAL COMBUSTION ENGINE

BACKGROUND

The present invention relates to a control method and a control device for a vehicular internal combustion engine structured to be shifted into a stoichiometric combustion mode in which a target air fuel ratio is set at or close to a stoichiometric air fuel ratio, and a lean combustion mode in which the target air fuel ratio is set lean, and particularly to a control method and a control device for a vehicular internal combustion engine where an electric intake air supply device is required to operate under a specific operating condition when in the lean combustion mode.

An internal combustion engine is known which is structured to be shifted into a stoichiometric combustion mode in which a target air fuel ratio is set to a stoichiometric air fuel ratio, and a lean combustion mode in which the target air fuel ratio is set lean. For this internal combustion engine, it is desirable to employ the lean combustion mode under a wider engine operating condition (engine torque and speed), in order to reduce fuel consumption.

A patent document 1 discloses supercharging of an internal combustion engine by an electric compressor driven by an on-vehicle battery. Patent document 1 describes that if a motor of the electric compressor is in a region of temperature where operation of the motor is limited, the internal combustion engine is substantially in a non-boost state (i.e. normal aspiration) even when in a region of boost.

In general, an NOx emission quantity emitted by an internal combustion engine (so-called engine-out NOx emission quantity) is reduced when an air fuel ratio is sufficiently lean, and is increased when a degree of being lean is insufficient. Under such a condition of lean combustion, a typical three-way catalyst does not function well. Accordingly, it is desirable to prevent an intermediate air fuel ratio between a sufficiently lean air fuel ratio and a stoichiometric air fuel ratio from being employed, in order to suppress the engine-out NOx emission quantity while reducing fuel consumption.

In order to achieve a sufficiently high air fuel ratio, it is required to supply a large quantity of air into a cylinder. If it is impossible to ensure a large quantity of air under an atmospheric pressure, it may require a supercharging means or intake air supply device.

If an electric intake air supply device such as an electric compressor is employed as an intake air supply device for lean combustion, it is possible that when a battery is in an insufficient state of charge, a motor rotation speed falls, and air supply becomes short with respect to a target lean air fuel ratio, so that an actual air fuel ratio becomes lower than the target lean air fuel ratio. This causes an increase in the engine-out NOx emission quantity.

In view of the foregoing, it is desirable to prevent employment of a less preferable intermediately lean air fuel ratio between a lean air fuel ratio and a stoichiometric air fuel ratio, wherein the NOx emission quantity is small at the lean air fuel ratio and at the stoichiometric air fuel ratio, and thereby prevent the engine-out NOx emission quantity from being increased.

Patent Document(s)

Patent Document 1: Japanese Patent Application Publication No. 2009-228586

SUMMARY

According to the present disclosure, a control method and a control device for an internal combustion engine system are provided with an internal combustion engine and an electric intake air supply device, wherein the internal combustion engine is structured to be shifted into a stoichiometric combustion mode in which a target air fuel ratio is set at or close to a stoichiometric air fuel ratio, and a lean combustion mode in which the target air fuel ratio is set lean, and wherein the electric intake air supply device is structured to be driven by an on-vehicle battery, and employed to contribute a part of intake air quantity at least under a specific operating condition when in the lean combustion mode.

According to the present disclosure, it includes predefining a stoichiometric combustion operation region employing the stoichiometric combustion mode and a lean combustion operation region employing the lean combustion mode, with respect to a torque and a rotation speed of the internal combustion engine as parameters; determining an electric energy of the electric intake air supply device that is required to maintain achievement of the target air fuel ratio of the lean combustion mode when in the lean combustion operation region; and causing a shift from the lean combustion mode into the stoichiometric combustion mode when the on-vehicle battery is in an insufficient state of charge with respect to the electric energy.

Accordingly, when the on-vehicle battery is in an insufficient state of charge so that achievement of the target air fuel ratio of the lean combustion mode cannot be maintained, operation is shifted into the stoichiometric combustion mode wherein the air fuel ratio is at or close to the stoichiometric air fuel ratio. At or close to the stoichiometric air fuel ratio, exhaust gas purification is possible by a three-way catalyst.

DETAILED DESCRIPTION

The following describes an embodiment of the present invention in detail with reference to the drawings.

Figure 1:
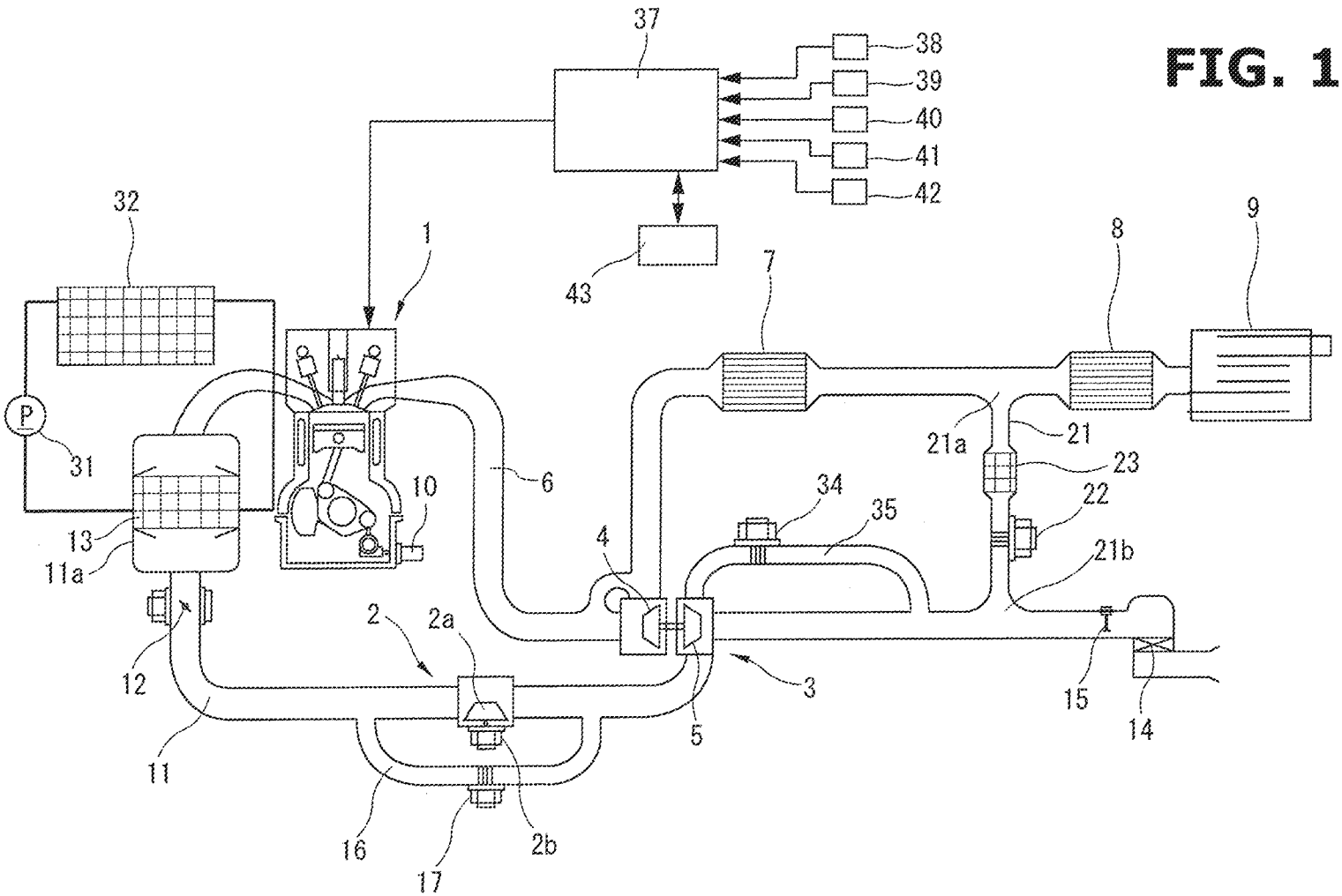
FIG. 1 is an illustrative view showing configuration of an internal combustion engine system according to an embodiment of the present invention.

FIG. 1 shows system configuration of an internal combustion engine 1 according to an embodiment of the present invention. The embodiment employs an electric supercharger 2 and a turbocharger 3 together as supercharging means. Internal combustion engine 1 is a four-stroke-cycle spark-ignition gasoline engine in this example, and is structured to be shifted into a stoichiometric combustion mode in which a target air fuel ratio is set at or close to a stoichiometric air fuel ratio (i.e. excess air ratio $\lambda=1$), and a lean combustion mode in which the target air fuel ratio is set lean (i.e. $\lambda=2$ or its proximity).

Internal combustion engine 1 includes an exhaust passage 6 in which an exhaust turbine 4 of turbocharger 3 is disposed and an upstream exhaust catalytic converter 7 and a downstream exhaust catalytic converter 8 are disposed downstream of exhaust turbine 4, wherein each exhaust catalytic converter is composed of a three-way catalyst. Each of upstream exhaust catalytic converter 7 and downstream exhaust catalytic converter 8 may be composed of a so-called NOx storage catalyst. In a further downstream section of exhaust passage 6, an exhaust silencer 9 is provided. Exhaust passage 6 is opened to the outside through exhaust silencer 9. Exhaust turbine 4 is provided with a publicly-known waste gate valve not shown for boost pressure control.

Internal combustion engine 1 is provided with a variable compression ratio mechanism employing a multilink mechanism as a piston-crank mechanism in this example, wherein the variable compression ratio mechanism includes an electric actuator 10 for varying a compression ratio. At least one of an intake valve set and an exhaust valve set may be provided with an electric variable valve timing mechanism and/or an electric variable valve lift mechanism.

Internal combustion engine 1 includes an intake passage 11 in which a compressor 5 of turbocharger 3 is disposed, and an electronically controlled throttle valve 12 is disposed downstream of compressor 5 for controlling a quantity of intake air. Throttle valve 12 is located at an inlet side of a collector section 11*a*. On the downstream side of collector section 11*a*, intake passage 11 is branched as an intake manifold to each cylinder. In collector section 11*a*, an intercooler 13 is provided for cooling supercharged air. Intercooler 13 is of a water-cooled type in which cooling water is circulated by action of a pump 31 in a system including a radiator 32.

For compressor 5, a recirculation passage 35 is arranged to allow communication between an outlet side of compressor 5 and an inlet side of compressor 5, and is provided with a recirculation valve 34. When internal combustion engine 1 is decelerating, i.e. when throttle valve 12 is rapidly closed, recirculation valve 34 is controlled into an opened state, thereby allowing pressurized intake air to be recirculated to compressor 5 via recirculation passage 35.

In an upstream end section of intake passage 11, an air cleaner 14 is disposed, and an air flow meter 15 is disposed downstream of air cleaner 14 for sensing the intake air quantity. Electric supercharger 2 is disposed between compressor 5 and collector section 11*a*. In this way, in intake passage 11, compressor 5 of turbocharger 3 and electric supercharger 2 are arranged in series, wherein electric supercharger 2 is located downstream of compressor 5.

Electric supercharger 2 includes an inlet side and an outlet side which are connected to each other via a bypass passage 16 outside of electric supercharger 2. Bypass passage 16 is provided with a bypass valve 17 for opening and closing the bypass passage 16. When electric supercharger 2 is at rest, bypass valve 17 is in an opened state.

Electric supercharger 2 includes: a compressor 2*a* provided in intake passage 11; and an electric motor 2*b* for driving the compressor 2*a*. In FIG. 1, compressor 2*a* is shown as a centrifugal compressor similar to compressor 5 of turbocharger 3, but may be implemented by a compressor of an arbitrary type such as a roots blower or a screw-type compressor. Electric motor 2*b* is driven by an on-vehicle battery not shown as a power supply. In the present embodiment, electric supercharger 2 serves as an electric intake air supply device.

Between exhaust passage 6 and intake passage 11, an exhaust gas recirculation passage 21 is provided for recirculating a part of exhaust gas into an intake air system. Exhaust gas recirculation passage 21 includes a first end 21*a* as an upstream end, which is branched from a section of exhaust passage 6 downstream of exhaust turbine 4, specifically, branched from a section between upstream exhaust catalytic converter 7 and downstream exhaust catalytic converter 8. Exhaust gas recirculation passage 21 includes a second end 21*b* as a downstream end, which is connected to a section of intake passage 11 upstream of compressor 5. In an intermediate section of exhaust gas recirculation passage 21, an exhaust gas recirculation valve 22 is disposed, and includes an opening that is controlled variably in accordance with an operating condition. Furthermore, in a section of exhaust gas recirculation passage 21 between exhaust gas recirculation valve 22 and exhaust passage 6, an EGR gas cooler 23 is disposed for cooling recirculated exhaust gas.

Internal combustion engine 1 is controlled in an integrated manner by an engine controller 37. Engine controller 37 receives input of sensing signals from various sensors, namely, air flow meter 15, a crank angle sensor 38 for sensing an engine speed, a water temperature sensor 39 for sensing a cooling water temperature, an accelerator opening sensor 40 for sensing an amount of depression of an accelerator pedal operated by an operator, and serving as a sensor for sensing a torque request by an operator, a boost pressure sensor 41 for sensing a boost pressure (intake air pressure) in collector section 11*a*, an air fuel ratio sensor 42 for sensing an exhaust air fuel ratio, etc. Engine controller 37 is connected to a battery controller 43 for sensing a state of charge or SOC of a battery not shown, and receives input of a signal indicative of the SOC from battery controller 43. Based on these sensing signals, engine controller 37 optimally controls a fuel injection quantity, a fuel injection timing, an ignition timing, the opening of throttle valve 12, action of electric supercharger 2, the opening of bypass valve 17, the opening of the wastegate valve not shown, the opening of recirculation valve 34, the opening of exhaust gas recirculation valve 22, etc. of internal combustion engine 1.

Figure 2:
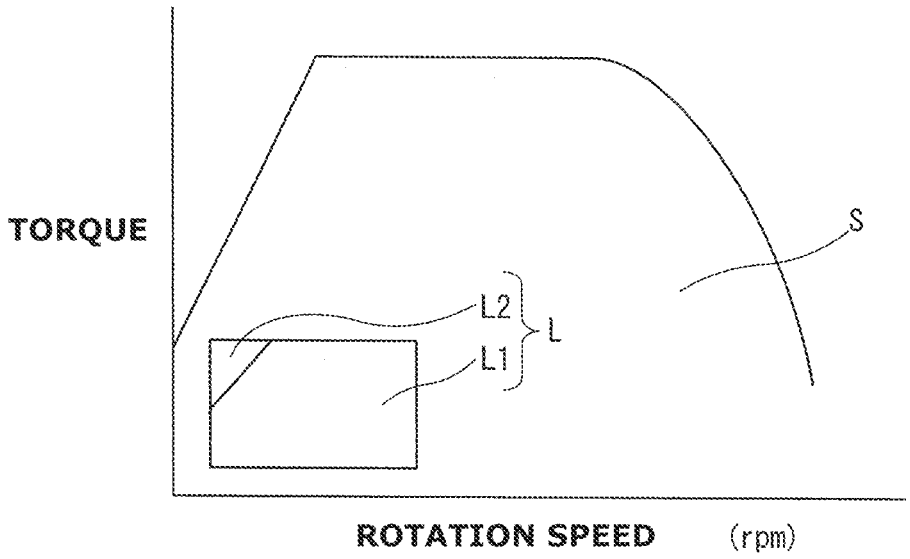
FIG. 2 is an illustrative view showing a control map defining a stoichiometric combustion operation region and a lean combustion operation region.

FIG. 2 shows a control map defining a stoichiometric combustion operation region S and a lean combustion operation region L with respect to the torque (or load) and rotation speed of internal combustion engine 1 as parameters, wherein the stoichiometric combustion mode should be employed when in the stoichiometric combustion operation region S, and the lean combustion mode should be employed when in the lean combustion operation region L. The control map is stored beforehand in a memory device of engine controller 37 together with target air fuel ratio maps described below. The lean combustion operation region L is set in a region where the engine torque is relatively small and the engine speed is middle or low. The region other than the lean combustion operation region L is basically occupied by the stoichiometric combustion operation region S. Although not shown specifically in FIG. 2, in a part of the stoichiometric combustion operation region S close to full throttle operation, the target air fuel ratio is slightly richer than the stoichiometric air fuel ratio. The lean combustion operation region L includes a first lean combustion operation region L1 in which air supply does not depend on electric supercharger 2, and a second lean combustion operation region L2 in which air supply depends on electric supercharger 2. The second lean combustion operation region L2 is a part of the lean combustion operation region L where the engine speed is low and the load is high. In the second lean combustion operation region L2, electric supercharger 2 is employed to contribute a part of the intake air quantity.

When the operating condition (torque and rotation speed) of internal combustion engine 1 is in the stoichiometric combustion operation region S, internal combustion engine 1 is operated in the stoichiometric combustion mode where a stoichiometric air fuel ratio map is employed as a target air fuel ratio map, and the fuel injection timing and ignition timing and others are set suitable for stoichiometric combustion. A target air fuel ratio map is a map where the target air fuel ratio is set for each operating point defined by the torque and rotation speed. In the stoichiometric air fuel ratio map employed by the stoichiometric combustion mode, the target air fuel ratio is set at or close to the stoichiometric air fuel ratio for each operating point in both of the stoichiometric combustion operation region S and the lean combustion operation region L. In the present disclosure, "at or close to the stoichiometric air fuel ratio" means a range of air fuel ratio that allows a three way catalyst to function, and in this example, means a range of 14.5-15.0 under assumption that the stoichiometric air fuel ratio is equal to 14.7. In the stoichiometric air fuel ratio map, the target air fuel ratio may be set to 14.7 for every operating point, or may be set to a different value of 14.6 or 14.8 at some operating points based on other conditions.

On the other hand, when the operating condition of internal combustion engine 1 is in the lean combustion operation region L, internal combustion engine 1 is operated in the lean combustion mode where a lean air fuel ratio map is employed as a target air fuel ratio map, and the fuel injection timing and ignition timing and others are set suitable for lean combustion. In the lean air fuel ratio map employed by the lean combustion mode, the target air fuel ratio is set lean for each operating point in the lean combustion operation region L. The target air fuel ratio being "lean" in the lean combustion mode is a lean air fuel ratio at which the engine-out NOx emission quantity is low to some extent, and in this embodiment, in a range of 25-33 close to a condition of $\lambda=2$. This range is only an example. In the present disclosure, the lean air fuel ratio in the lean combustion mode may be arbitrary as long as the lean air fuel ratio is in a lean range that is discontinuous with the air fuel ratio range close to the stoichiometric air fuel ratio for the stoichiometric air fuel ratio map (namely, as long as the two ranges are separated away from each other). In the lean air fuel ratio map, normally, the target air fuel ratio is not set constant for the operating points, but is set slightly different depending on the torque and rotation speed. The lean air fuel ratio map may be set to include data about the target air fuel ratios for the operating points in the stoichiometric combustion operation region S. In this setting, the target air fuel ratio is set at or close to the stoichiometric air fuel ratio for each operating point in the stoichiometric combustion operation region S.

In the lean combustion operation region L, the target air fuel ratio setting for the first lean combustion operation region L1 is not different significantly from that for the second lean combustion operation region L2. The target air fuel ratio is set lean around the condition of $\lambda=2$ as described above, for both of the first lean combustion operation region L1 and the second lean combustion operation region L2. However, the target air fuel ratio being lean can be achieved without employment of electric supercharger 2 in the first lean combustion operation region L1, but cannot be achieved in the second lean combustion operation region L2, if electric intake air supply device 2 cannot function as desired, because the target air fuel ratio for the second lean combustion operation region L2 is set under assumption that electric supercharger 2 is operating.

If operation in the lean combustion operation region L, especially, in the second lean combustion operation region L2, continues, and a condition where electric energy consumption of on-vehicle electric components including the electric supercharger 2 is above an electric energy generated by an electric generator driven by internal combustion engine 1 continues, the battery SOC falls gradually. Accordingly, it is possible that electric power supplied to electric supercharger 2 becomes short after a while, thereby reducing intake air supply of electric supercharger 2, and cannot allow achievement of the target air fuel ratio being lean. In such a situation, if the actual air fuel ratio falls depending on the intake air quantity that can be supplied, the engine-out NOx emission quantity increases as described above.

In view of the foregoing, the present embodiment is configured to force a shift into the stoichiometric combustion mode in which the target air fuel ratio is set at or close to the stoichiometric air fuel ratio based on the stoichiometric air fuel ratio map, if the battery SOC is less than or equal to a predetermined threshold (or lower limit) when in the second lean combustion operation region L2. When the air fuel ratio is at or close to the stoichiometric air fuel ratio, the three-way catalysts can function for exhaust gas purification, so that the NOx emission quantity to the outside is reduced.

Figure 3:
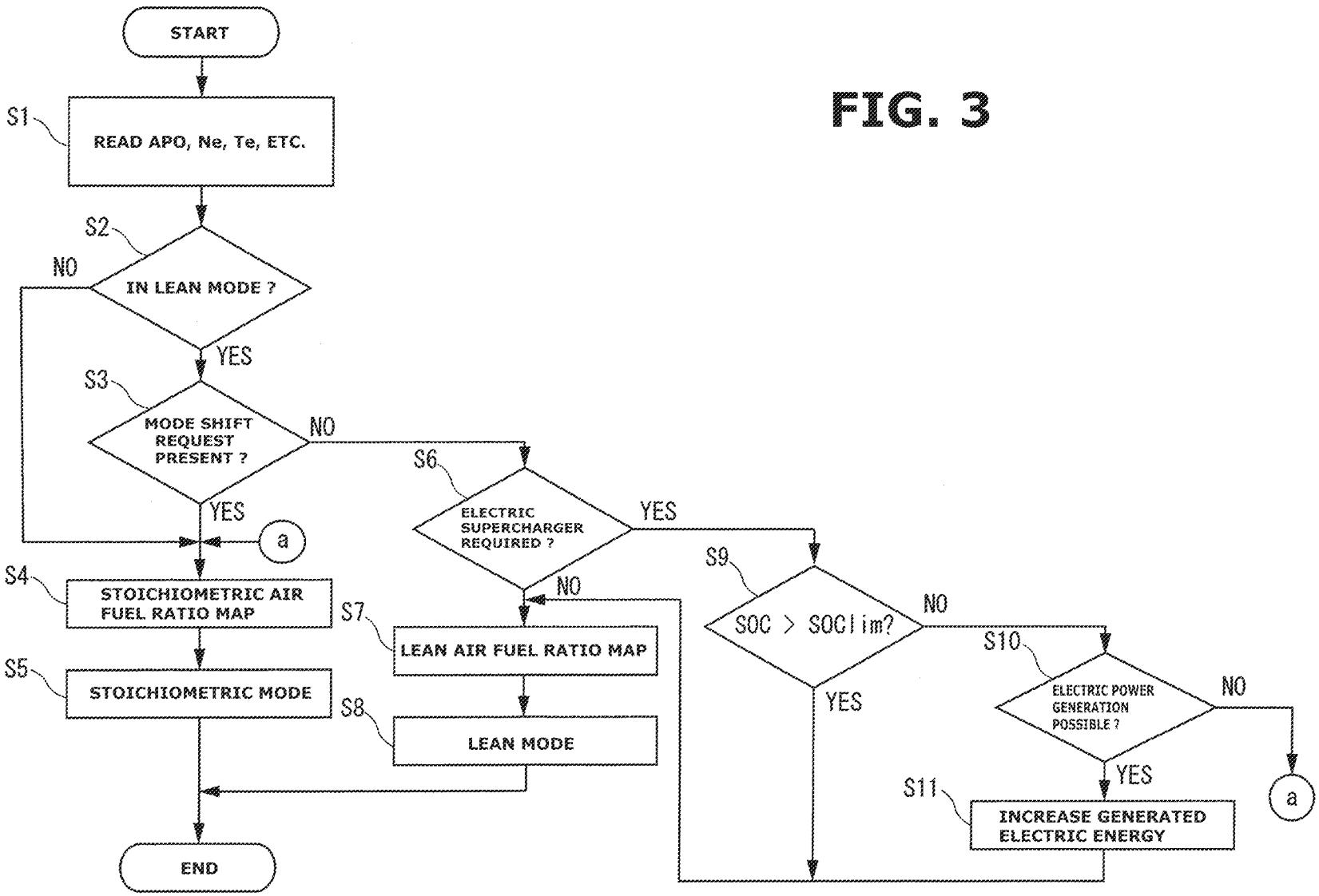
FIG. 3 is a flow chart showing a flow of combustion mode shift control.

FIG. 3 is a flow chart showing a flow of such combustion mode shift control. The flow chart shows a routine that is executed repeatedly by engine controller 37 at intervals of a predetermined calculation cycle. At Step 1, engine controller 37 reads various parameters from signals inputted from the sensors, and internal signals calculated in engine controller 37. Specifically, engine controller 37 reads accelerator opening APO (amount of depression of the accelerator pedal), rotation speed Ne and torque Te, etc. of internal combustion engine 1.

At Step 2, engine controller 37 determines whether or not the current operation mode is the lean combustion mode. When determining that the current operation mode is the stoichiometric combustion mode, engine controller 37 proceeds from Step 2 to Step 4, and selects the stoichiometric air fuel ratio map as a target air fuel ratio map, and then proceeds to Step 5, and continues operation in the stoichiometric combustion mode. The shift from the stoichiometric combustion mode into the lean combustion mode (the shift from the stoichiometric combustion operation region S into the lean combustion operation region L) is handled by another routine not shown.

When determining that the current operation mode is the lean combustion mode, engine controller 37 proceeds from Step 2 to Step 3, and determines whether or not a request for a shift from the lean combustion mode into the stoichiometric combustion mode (in other words, a request for a shift from the lean combustion operation region L into the stoichiometric combustion operation region S) is present, based on the current operating point, an amount of change of accelerator opening APO, etc. When determining that a request for a shift into the stoichiometric combustion mode is present, engine controller 37 then proceeds from Step 3 to Step 4, and selects the stoichiometric air fuel ratio map as a target air fuel ratio map, and then proceeds to Step 5, and shifts operation into the stoichiometric combustion mode.

When determining that no request for a shift from the lean combustion mode into the stoichiometric combustion mode is present, engine controller 37 then proceeds to Step 6, and determines whether or not electric supercharger 2 is required for lean combustion. In other words, engine controller 37 determines whether the current operating point is in the second lean combustion operation region L2 or in the first lean combustion operation region L1. When determining that electric supercharger 2 is not required, namely, when determining that it is in the first lean combustion operation region L1, engine controller 37 then proceeds from Step 6 to Step 7, and selects the lean air fuel ratio map as a target air fuel ratio map, and then proceeds to Step 8, and continues operation into the lean combustion mode.

When determining that electric supercharger 2 is required, namely, when determining that it is in the second lean combustion operation region L2, engine controller 37 then proceeds from Step 6 to Step 9, and determines whether or not the battery SOC is greater than a predetermined lower limit SOClim. The lower limit SOClim is set so as to satisfy an electric energy of electric supercharger 2 sufficient to maintain achievement of the target air fuel ratio of the lean combustion mode when in the second lean combustion operation region L2. Specifically, the lower limit SOClim is set based on a sum of a first electric energy and a second electric energy (i.e. total electric energy request), wherein the first electric energy is an electric energy of electric supercharger 2 required to maintain achievement of the target air fuel ratio of the lean combustion mode when in the second lean combustion operation region L2, and wherein the second electric energy is an electric energy required by other electric components including an electric component accompanying the internal combustion engine 1, such as electric actuator 10 for the variable compression ratio mechanism. The required electric energy of electric supercharger 2 correlates with a pressure difference between inlet-side pressure and outlet-side pressure of electric supercharger 2, and can be estimated from various parameters including torque Te and rotation speed Ne of internal combustion engine 1. Therefore, the lower limit SOClim may be calculated successively, or may be preset to a value for each operating point in the second lean combustion operation region L2. Alternatively, for simplification of the control, the lower limit SOClim may be a constant value taking account of a suitable margin.

When determining at Step 9 that the battery SOC is greater than the lower limit SOClim, engine controller 37 then proceeds to Steps 7 and 8, and continues operation in the lean combustion mode employing the lean air fuel ratio map.

When determining at Step 9 that the battery SOC is less than or equal to the lower limit SOClim, engine controller 37 then proceeds to Step 10, and determines whether or not the air fuel ratio is to be maintained lean by increase of the electric energy generated by the electric generator provided with internal combustion engine 1. For example, if the capacity of electric power generation of the electric generator is sufficient, and the increase in fuel consumption due to the increase in generated electric energy is less than the decrease in fuel consumption caused by employment of lean combustion, it is selected to increase the generated electric energy. In this case, engine controller 37 then proceeds from Step 10 to Step 11, and increases the generated electric energy. Then, engine controller 37 proceeds to Steps 7 and 8, and continues operation in the lean combustion mode employing the lean air fuel ratio map.

On the other hand, if the capacity of electric power generation of the electric generator is not sufficient, or if the increase in fuel consumption due to the increase in generated electric energy is greater than the decrease in fuel consumption caused by employment of lean combustion, or if it is not preferable that the operating point changes due to increase in generated electric energy, the answer to Step 10 is determined as negative. In this case, engine controller 37 then proceeds from Step 10 to Steps 4 and 5, and selects the stoichiometric air fuel ratio map as a target air fuel ratio map, and shifts operation into the stoichiometric combustion mode.

Figure 5:
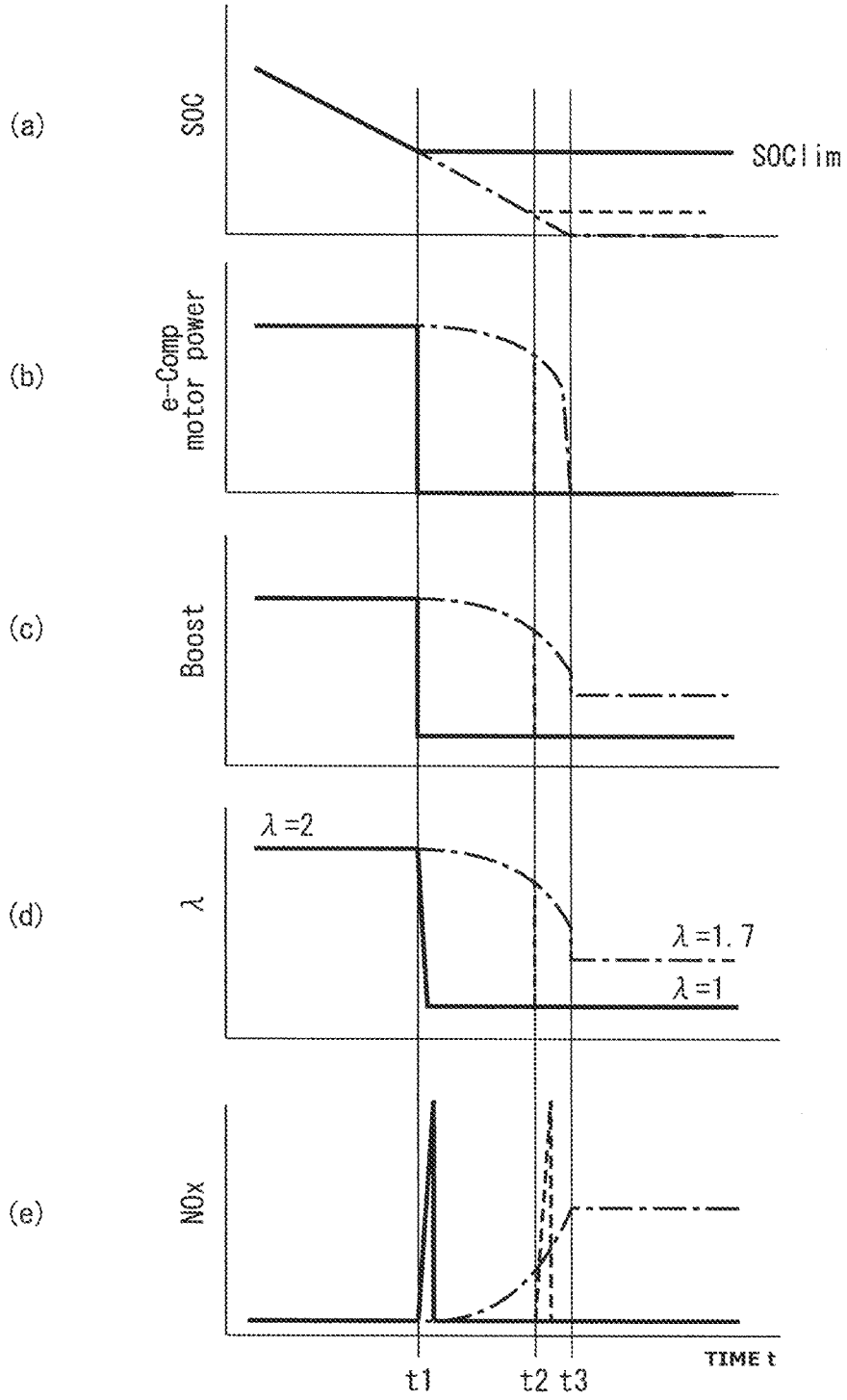
FIG. 5 is a time chart showing changes of SOC and others according to the embodiment.

FIG. 5 is a time chart illustrating behavior under the control described above, in a situation that operation in the second lean combustion operation region L2 is continued. In FIG. 5, (a) shows changes of the battery SOC, (b) shows changes of electric power supplied to electric supercharger 2, (c) shows changes of the boost pressure of internal combustion engine 1, (d) shows changes of the excess air ratio of internal combustion engine 1, and (e) shows changes of the NOx emission quantity. When in the second lean combustion operation region L2, operation is performed in the lean combustion mode with employment of electric supercharger 2 as shown in (b), so that the boost pressure is high as shown in (c), and the air fuel ratio is maintained at or close to $\lambda=2$. Meanwhile, electric power consumption of electric supercharger 2 causes the battery SOC to fall gradually as shown in (a). At a time instant t1, the battery SOC has decreased to the lower limit SOClim, so that a shift into the stoichiometric combustion mode is forced in the present embodiment as described above. Namely, electric supercharger 2 is stopped, to reduce the boost pressure, and bring the air fuel ratio at or close to the stoichiometric air fuel ratio. As shown in FIG. 5, the air fuel ratio changes in a stepwise manner from the proximity of $\lambda=2$ to the stoichiometric air fuel ratio. In this situation, the NOx emission quantity increases temporarily because the air fuel ratio passes through the intermediate band of air fuel ratio. However, the total increase of the total NOx quantity is relatively small, because the duration where the NOx is degraded is short.

In FIG. 5, imaginary lines represent characteristics for a situation of a first comparative example where the lean combustion mode is continued even when the battery SOC has decreased. In this situation, the decrease in the battery SOC causes the power supply to electric supercharger 2 to be insufficient, and causes the boost pressure to fall. Accordingly, the excess air ratio becomes unable to be maintained at the target "$\lambda=2$", and after a time instant t3 when electric supercharger 2 is stopped, remains at or close to "$\lambda=1.7$" in this example. This causes an increase in the NOx emission quantity as shown in (e).

In FIG. 5, broken lines represent characteristics for a situation of a second comparative example in which the shift into the stoichiometric combustion mode is forced at a stage (at a time instant t2) where the rotation speed of electric supercharger 2 has fallen to some extent. In this case, after the excess air ratio has fallen from "$\lambda=2$" to some extent, the excess air ratio changes in a stepwise manner to the proximity of the stoichiometric air fuel ratio. Therefore, the NOx emission quantity is smaller after time instant t3 than in the first comparative example, but the total NOx quantity is larger due to the increase in the NOx emission quantity during the duration from time instant t1 to time instant t2 than the embodiment.

Figure 4:
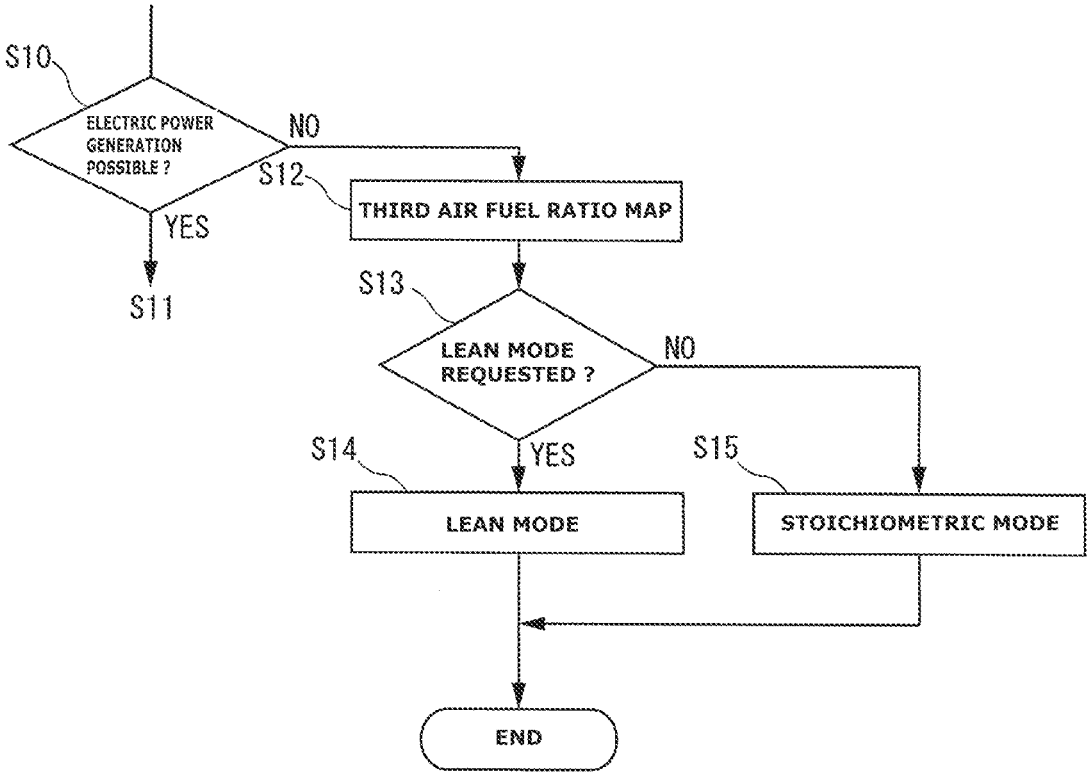
FIG. 4 is a flow chart showing a related part of an embodiment provided with a third air fuel ratio map.

Next, FIG. 4 shows a related part of a flow chart according to a second embodiment provided with a third air fuel ratio map that is employed when the battery SOC has fallen, in addition to the stoichiometric air fuel ratio map and lean air fuel ratio map employed normally. The part of the flow chart not shown is similar to the flow chart of FIG. 3. In the third air fuel ratio map, the target air fuel ratio is set at or close to the stoichiometric air fuel ratio or set lean, for each operating point in an operation region including both of the stoichiometric combustion operation region S and the lean combustion operation region L, under assumption that electric supercharger 2 is at rest. For example, in the stoichiometric combustion operation region S and the second lean combustion operation region L2, the target air fuel ratio is set at or close to the stoichiometric air fuel ratio. In the first lean combustion operation region L1, the target air fuel ratio is basically set to be in the proximity of λ=2. If the target air fuel ratio is set lean at or close to a boundary between the first lean combustion operation region L1 and the second lean combustion operation region L2, the target air fuel ratio is set to a relatively small value such as 28.0 in the proximity of λ=2, and the area of lean air fuel ratio is broadened as wide as possible, in consideration of stop of electric intake air supply device 2.

As shown in FIG. 4, when the battery SOC becomes lower than or equal to the lower limit SOClim and it is not selected to increase the generated electric energy, it proceeds from Step 10 to Step 12, and selects the third air fuel ratio map as a target air fuel ratio map. Then, it proceeds to Step 13, and determines whether or not the lean combustion mode is to be selected as a combustion mode defining the ignition timing and others, in accordance with the value of the target air fuel ratio that is set for the current operating point in the third air fuel ratio map. In case of YES, it proceeds to Step 14, and operates internal combustion engine 1 in the lean combustion mode. When the target air fuel ratio given by the third air fuel ratio map is in the proximity of the stoichiometric air fuel ratio, the answer to Step 13 is determined as negative, and it proceeds to Step 15, and operates internal combustion engine 1 in the stoichiometric combustion mode.

Although the foregoing describes the specific embodiments of the present invention in detail, the present invention is not limited to the embodiments, but contains various modifications. For example, although the shown embodiment is configured such that the lean air fuel ratio is in the proximity of λ=2, the present invention is not limited so, but may employ arbitrary lean air fuel ratios as appropriate. Although the shown embodiment includes electric supercharger 2 as an electric intake air supply device, the electric intake air supply device may be implemented by another type such as an electric assist turbocharger where rotation of a rotor driven by exhaust gas energy is assisted by an electric motor. It may be configured to employ both of an electric supercharger and an electric assist turbocharger.

The invention claimed is:

1. A control method for a vehicular internal combustion engine system including an internal combustion engine and an electric intake air supply device, wherein the internal combustion engine is structured to be shifted into a stoichiometric combustion mode in which a target air fuel ratio is set at or close to a stoichiometric air fuel ratio, and a lean combustion mode in which the target air fuel ratio is set lean, and wherein the electric intake air supply device is structured to be driven by an on-vehicle battery, and employed to contribute a part of intake air quantity at least under a specific operating condition when in the lean combustion mode, the control method comprising:

predefining a stoichiometric combustion operation region employing the stoichiometric combustion mode and a lean combustion operation region employing the lean combustion mode, with respect to a torque and a rotation speed of the internal combustion engine as parameters;

preparing a lean air fuel ratio map, a stoichiometric air fuel ratio map, and a third air fuel ratio map, wherein:

in the lean air fuel ratio map, the target air fuel ratio is set lean for each operating point in the lean combustion operation region;

in the stoichiometric air fuel ratio map, the target air fuel ratio is set at or close to the stoichiometric air fuel ratio for each operating point at least in the stoichiometric combustion operation region; and in the third air fuel ratio map, the target air fuel ratio is set at or close to the stoichiometric air fuel ratio, or lean, for each operating point in an operation region containing both of the stoichiometric combustion operation region and the lean combustion operation region, under assumption that the electric intake air supply device is at rest;

determining an electric energy of the electric intake air supply device that is required to maintain achievement of the target air fuel ratio of the lean combustion mode when in the lean combustion operation region; and causing a shift from the lean combustion mode into the stoichiometric combustion mode by employing the third air fuel ratio map when the on-vehicle battery is in an insufficient state of charge with respect to the electric energy.

2. The control method as claimed in claim 1, comprising:

setting a lower limit of SOC of the on-vehicle battery, based on an electric energy required to drive the electric intake air supply device and an electric energy required by other on-vehicle electric components; and determining whether or not the on-vehicle battery is in an insufficient state of charge, by comparison between the SOC of the on-vehicle battery and the lower limit.

3. A control method for a vehicular internal combustion engine system including an internal combustion engine and an electric intake air supply device, wherein the internal combustion engine is structured to be shifted into a stoichiometric combustion mode in which a target air fuel ratio is set at or close to a stoichiometric air fuel ratio, and a lean combustion mode in which the target air fuel ratio is set lean, and wherein the electric intake air supply device is structured to be driven by an on-vehicle battery, and employed to contribute a part of intake air quantity at least under a specific operating condition when in the lean combustion mode, the control method comprising:

predefining a stoichiometric combustion operation region employing the stoichiometric combustion mode and a lean combustion operation region employing the lean combustion mode, with respect to a torque and a rotation speed of the internal combustion engine as parameters;

determining an electric energy of the electric intake air supply device that is required to maintain achievement of the target air fuel ratio of the lean combustion mode when in the lean combustion operation region; and selecting one of first and second operations, based on a predetermined condition, in response to determination that the on-vehicle battery is in an insufficient state of charge with respect to the electric energy, wherein the first operation is to cause a shift from the lean combustion mode into the stoichiometric combustion mode, and wherein the second operation is to maintain the lean combustion mode by increasing an electric energy that is generated by an electric generator driven by the internal combustion engine.

4. The control method as claimed in claim 3, comprising:

setting a lower limit of SOC of the on-vehicle battery, based on an electric energy required to drive the electric intake air supply device and an electric energy required by other on-vehicle electric components; and determining whether or not the on-vehicle battery is in an insufficient state of charge, by comparison between the SOC of the on-vehicle battery and the lower limit.

5. A control device for a vehicular internal combustion engine system including an internal combustion engine and an electric intake air supply device, wherein the internal combustion engine is structured to be shifted into a stoichiometric combustion mode in which a target air fuel ratio is set at or close to a stoichiometric air fuel ratio, and a lean combustion mode in which the target air fuel ratio is set lean, and wherein the electric intake air supply device is structured to be driven by an on-vehicle battery, and employed to contribute a part of intake air quantity at least under a specific operating condition when in the lean combustion mode, the control device comprising:

a controller configured to:

prepare a lean air fuel ratio map, a stoichiometric air fuel ratio map, and a third air fuel ratio map, with respect to a torque and a rotation speed of the internal combustion engine as parameters, wherein:

in the lean air fuel ratio map, the target air fuel ratio is set lean for each operating point in the lean combustion operation region;

in the stoichiometric air fuel ratio map, the target air fuel ratio is set at or close to the stoichiometric air fuel ratio for each operating point at least in the stoichiometric combustion operation region; and in the third air fuel ratio map, the target air fuel ratio is set at or close to the stoichiometric air fuel ratio, or lean, for each operating point in an operation region containing both of the stoichiometric combustion operation region and the lean combustion operation region, under assumption that the electric intake air supply device is at rest;

determine an electric energy of the electric intake air supply device that is required to maintain achievement of the target air fuel ratio of the lean combustion mode when in the lean combustion operation region; and cause a shift from the lean combustion mode into the stoichiometric combustion mode by employing the third air fuel ratio map when the on-vehicle battery is in an insufficient state of charge with respect to the electric energy.

6. The control device as claimed in claim 5, wherein the controller is configured to:

set a lower limit of SOC of the on-vehicle battery, based on an electric energy required to drive the electric intake air supply device and an electric energy required by other on-vehicle electric components; and determine whether or not the on-vehicle battery is in an insufficient state of charge, by comparison between the SOC of the on-vehicle battery and the lower limit.

7. A control device for a vehicular internal combustion engine system including an internal combustion engine and an electric intake air supply device, wherein the internal combustion engine is structured to be shifted into a stoichiometric combustion mode in which a target air fuel ratio is set at or close to a stoichiometric air fuel ratio, and a lean combustion mode in which the target air fuel ratio is set lean, and wherein the electric intake air supply device is structured to be driven by an on-vehicle battery, and employed to contribute a part of intake air quantity at least under a specific operating condition when in the lean combustion mode, the control device comprising:

a controller configured to:

provide a control map predefining a stoichiometric combustion operation region employing the stoichiometric combustion mode and a lean combustion operation region employing the lean combustion mode, with respect to a torque and a rotation speed of the internal combustion engine as parameters;

determine an electric energy of the electric intake air supply device that is required to maintain achievement of the target air fuel ratio of the lean combustion mode when in the lean combustion operation region; and select one of first and second operations, based on a predetermined condition, in response to determination that the on-vehicle battery is in an insufficient state of charge with respect to the electric energy, wherein the first operation is to cause a shift from the lean combustion mode into the stoichiometric combustion mode, and wherein the second operation is to maintain the lean combustion mode by increasing an electric energy that is generated by an electric generator driven by the internal combustion engine.

8. The control device as claimed in claim 7, wherein the controller is configured to:

set a lower limit of SOC of the on-vehicle battery, based on an electric energy required to drive the electric intake air supply device and an electric energy required by other on-vehicle electric components; and determine whether or not the on-vehicle battery is in an insufficient state of charge, by comparison between the SOC of the on-vehicle battery and the lower limit.

* * * * *